US009558694B2

(12) United States Patent
Kim et al.

(10) Patent No.: US 9,558,694 B2
(45) Date of Patent: Jan. 31, 2017

(54) ORGANIC LIGHT EMITTING DISPLAY DEVICE

(71) Applicant: SAMSUNG DISPLAY CO., LTD., Yongin, Gyeonggi-Do (KR)

(72) Inventors: Cheol-Min Kim, Yongin (KR); Joo-Hyung Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 160 days.

(21) Appl. No.: 14/047,823

(22) Filed: Oct. 7, 2013

(65) Prior Publication Data

US 2014/0354713 A1 Dec. 4, 2014

(30) Foreign Application Priority Data

May 30, 2013 (KR) ..... 10-2013-0061675

(51) Int. Cl.
*G09G 3/3233* (2016.01)
*G09G 3/32* (2016.01)
*G09G 3/20* (2006.01)

(52) U.S. Cl.
CPC ..... *G09G 3/3258* (2013.01); *G09G 3/3233* (2013.01); *G09G 3/2022* (2013.01); *G09G 2300/043* (2013.01); *G09G 2300/0852* (2013.01); *G09G 2320/0233* (2013.01); *G09G 2320/0633* (2013.01); *G09G 2320/0666* (2013.01)

(58) Field of Classification Search
CPC ..... G09G 2320/0233
See application file for complete search history.

(56) References Cited

U.S. PATENT DOCUMENTS

2004/0251953 A1* 12/2004 Yamazaki ..... G09G 3/3233 327/512
2005/0012686 A1* 1/2005 Osame et al. ..... 345/39
2006/0244696 A1* 11/2006 Jung et al. ..... 345/77
2007/0200814 A1* 8/2007 Kwon ..... 345/92
2009/0027423 A1* 1/2009 Kwon ..... 345/690
2009/0309868 A1 12/2009 Jung et al.

FOREIGN PATENT DOCUMENTS

KR 2003-0044566 6/2003
KR 10-2009-0128888 12/2009

* cited by examiner

*Primary Examiner* — Chad Dicke
(74) *Attorney, Agent, or Firm* — Lewis Roca Rothgerber Christie LLP

(57) ABSTRACT

An organic light emitting display device, including pixels positioned at crossing regions of scan lines and data lines and a bias voltage supply configured to supply bias voltages to the pixels. Each of the pixels includes an organic light emitting diode (OLED), a first transistor coupled between a first power supply and the OLED and driven in a saturation region by a corresponding one of the bias voltages to supply a set current to the OLED, a second transistor coupled between the first power supply and the OLED and driven in a linear region by a data signal supplied from a corresponding one of the data lines to turn on or off, and a second capacitor coupled between a gate electrode of the first transistor and the first power supply.

15 Claims, 5 Drawing Sheets

ORGANIC LIGHT EMITTING DISPLAY DEVICE

CROSS-REFERENCE TO RELATED APPLICATION

This application claims priority to and the benefit of Korean Patent Application No. 10-2013-0061675, filed on May 30, 2013, in the Korean Intellectual Property Office, the entire content of which is incorporated herein by reference in its entirety.

BACKGROUND

1. Field

An aspect of the present invention relates to an organic light emitting display device.

2. Description of the Related Art

As an information technology is developed, importance of a display device that is a connection medium between a user and desired information is magnified. Accordingly, uses of flat panel display devices (FPD) including liquid crystal display devices (LCD), organic light emitting display devices, or plasma display panels (PDP) are increasing.

Among the FPDs, the organic light emitting display devices display images using organic light emitting diodes (OLED) that generate light by re-combination of electrons and holes. The organic light emitting display device has a high response speed and is driven with low power consumption.

SUMMARY

An aspect of an embodiment of the present invention relates to an organic light emitting display device capable of displaying an image with desired brightness.

An organic light emitting display device according to an embodiment of the present invention includes pixels positioned at crossing regions of scan lines and data lines and a bias voltage supply configured to supply bias voltages to the pixels. Each of the pixels includes an organic light emitting diode (OLED), a first transistor coupled between a first power supply and the OLED and driven in a saturation region by a corresponding one of the bias voltages to supply a set current to the OLED, a second transistor coupled between the first power supply and the OLED and driven in a linear region by a data signal supplied from a corresponding one of the data lines to turn on or off, and a second capacitor coupled between a gate electrode of the first transistor and the first power supply.

In one embodiment, each of the pixels includes a first capacitor coupled between a gate electrode of the second transistor and the first power supply and a third transistor coupled between the gate electrode of the second transistor and the data line and turned on when a scan signal is supplied to a corresponding one of the scan lines.

In one embodiment, the set current corresponds to the highest gray scale realized by a corresponding one of the pixels.

In one embodiment, the bias voltage supply supplies the bias voltages set as different voltages to a red pixel of the pixels that generates red light, a green pixel of the pixels that generates green light, and a blue pixel of the pixels that generates blue light.

In one embodiment, channel widths/lengths of the first transistors included in the red pixel that generates the red light, the green pixel that generates the green light, and the blue pixel that generates the blue light are set different from each other so that the set current corresponding to the highest gray scale flows to each of the red, green, and blue pixels.

In one embodiment, the organic light emitting display device further includes a scan driver configured to supply scan signals to the scan lines and a data driver configured to supply data signals, comprising the data signal, to the data lines.

In one embodiment, one frame is divided into a plurality of sub-frames and the scan driver supplies the scan signals to the scan lines in scan periods of the sub-frames.

In one embodiment, the data driver supplies a first data signal of the data signals at which the pixels emit light or a second data signal of the data signals at which the pixels do not emit light to each of the data lines in synchronization with the scan signals.

In one embodiment, the first transistor is positioned between the second transistor and the first power supply.

In one embodiment, the first transistor is positioned between the second transistor and the OLED.

DETAILED DESCRIPTION

Figure 1:
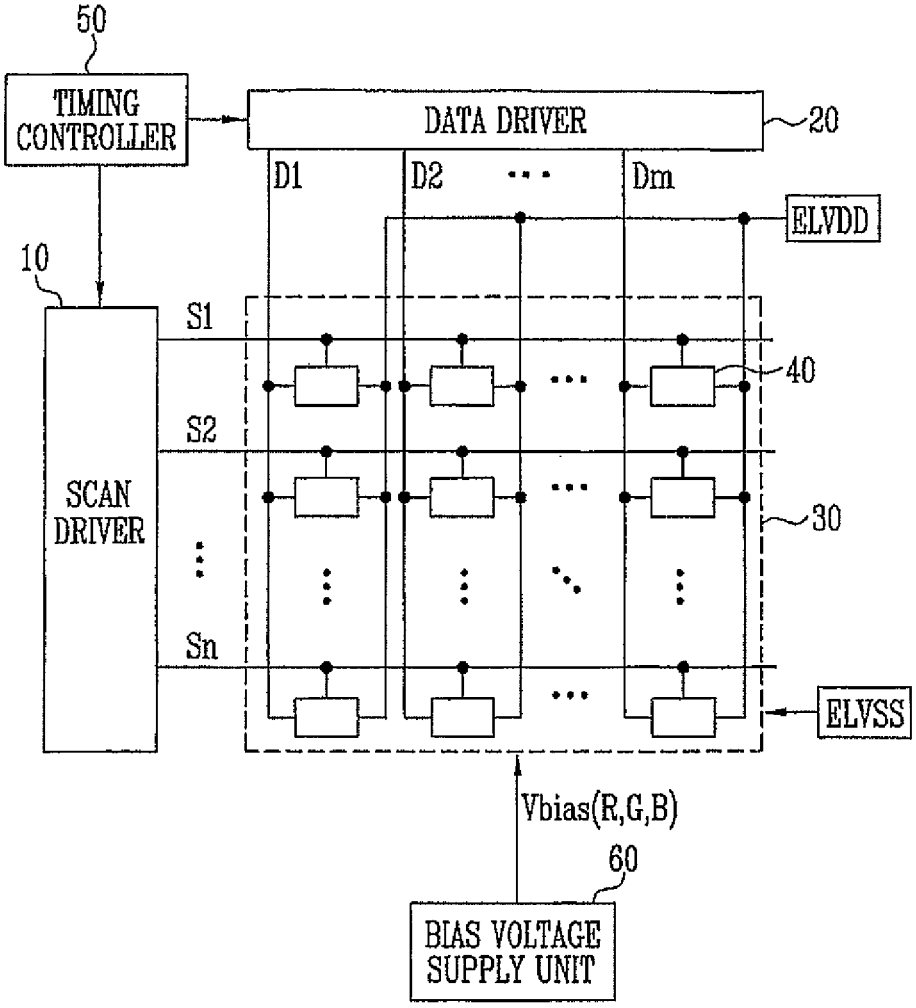
FIG. 1 is a view illustrating an organic light emitting display device according to an embodiment of the present invention.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout. Also, expressions such as "at least one of," when preceding a list of elements, modify the entire list of elements and do not modify the individual elements of the list. Further, the use of "may" when describing embodiments of the present invention refers to "one or more embodiments of the present invention."

FIG. 1 is a view illustrating an organic light emitting display device according to an embodiment of the present invention.

Referring to FIG. 1, an organic light emitting display device according to an embodiment of the present invention includes a pixel unit 30 including a plurality of pixels 40 positioned at crossing regions (e.g., at intersections) of scan lines S1 to Sn and data lines D1 to Dm, a scan driver 10 configured to drive the scan lines S1 to Sn, a data driver 20 configured to drive the data lines D1 to Dm, a bias voltage supply 60 configured to supply bias voltages Vbias (R, G, and B) to the pixels 40, and a timing controller 50 configured to control the scan driver 10 and the data driver 20.

The pixels 40 receive power voltages from a first power supply ELVDD and a second power supply ELVSS that are outside of the pixels 40. The pixels 40 that receive the first power supply ELVDD and the second power supply ELVSS generate light components with set or predetermined gray scales while being set in an emission state or a non-emission state to correspond to data signals. Here, currents supplied to organic light emitting diodes (OLED) in a period where the pixels 40 are set in the emission state are determined by the bias voltages Vbias (R, G, and B).

The bias voltage supply 60 supplies the bias voltages Vbias (R, G, and B) to each of the pixels 40. Here, the bias voltages Vbias (R, G, and B) are determined so that the pixels 40 generate light components with previously set brightness components. For example, values of the bias voltages Vbias (R, G, and B) may be set so that light with brightness corresponding to the highest gray scale (for example, white) is generated in the period where the pixels 40 emit light.

On the other hand, the pixels 40 that generate red, green, and blue light components may generate light components with different brightness components to correspond to the same bias voltage Vbias. Therefore, according to the present invention, the bias voltage supply 60 supplies a red bias voltage Vbias (R) to the pixel 40 that generates the red light and supplies a green bias voltage Vbias (G) to the pixel 40 that generates the green light. The bias voltage supply 60 supplies a blue bias voltage Vbias (B) to the pixel that generates the blue light. Here, the values of the red bias voltage Vbias (R), the green bias voltage (G), and the blue bias voltage Vbias (B) are set so that light components corresponding to the highest gray scales are generated by the pixels 40.

The scan driver 10 supplies scan signals to the scan lines S1 to Sn in scan periods of a plurality of sub-frames included in one frame. When the scan signals are supplied to the scan lines S1 to Sn, the pixels 40 are selected in units of horizontal lines.

The data driver 20 supplies the data signals to the data lines D1 to Dm in synchronization with the scan signals. Here, the data driver 20 supplies a first data signal by which the pixels 40 emit light components or a second data signal by which the pixels 40 do not emit light to each of the data lines D1 to Dm. The pixels 40 that receive the first data signal in a scan period are set in the emission state in an emission period after the scan period.

The timing controller 50 controls the scan driver 10 and the data driver 20 to correspond to synchronizing signals supplied from the outside.

Figure 2:
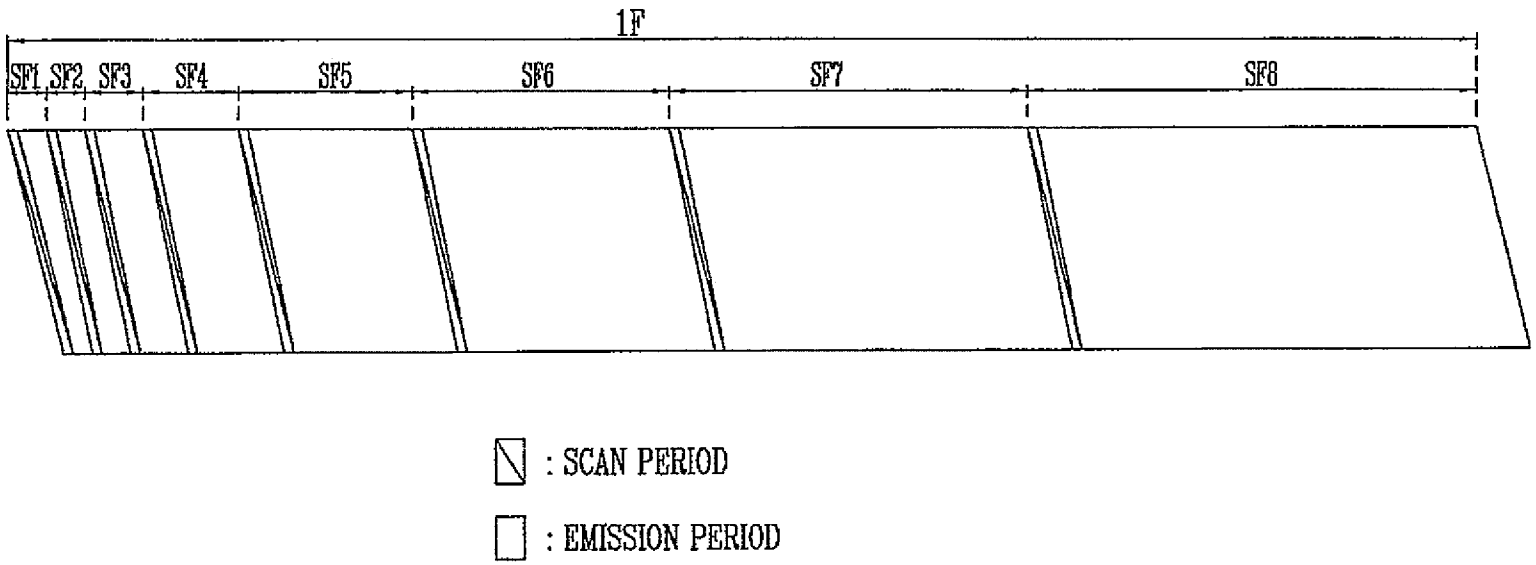
FIG. 2 is a view illustrating one frame according to an embodiment of the present invention.

FIG. 2 is a view illustrating one frame according to an embodiment of the present invention.

Referring to FIG. 2, one frame 1F according to the embodiment of the present invention is divided into a plurality of sub-frames SF1 to SF8. Each of the sub-frames SF1 to SF8 is divided into a scan period and an emission period. In the scan period, the scan signals are supplied to the scan lines S1 to Sn and the data signals are supplied to the data lines D1 to Dm in synchronization with the scan signals. Therefore, in the scan period, a voltage corresponding to the first data signal or the second data signal is charged in each of the pixels 40.

In the emission period, the pixels 40 that receive the first data signal in the scan period emit light. On the other hand, emission periods of the sub-frame SF1 to SF8 are set to be the same and/or different from each other so that set or predetermined gray scales may be realized. That is, the pixels 40 according to an embodiment of the present invention realize the set or predetermined gray scales to correspond to the emission periods of the one frame.

Figure 3:
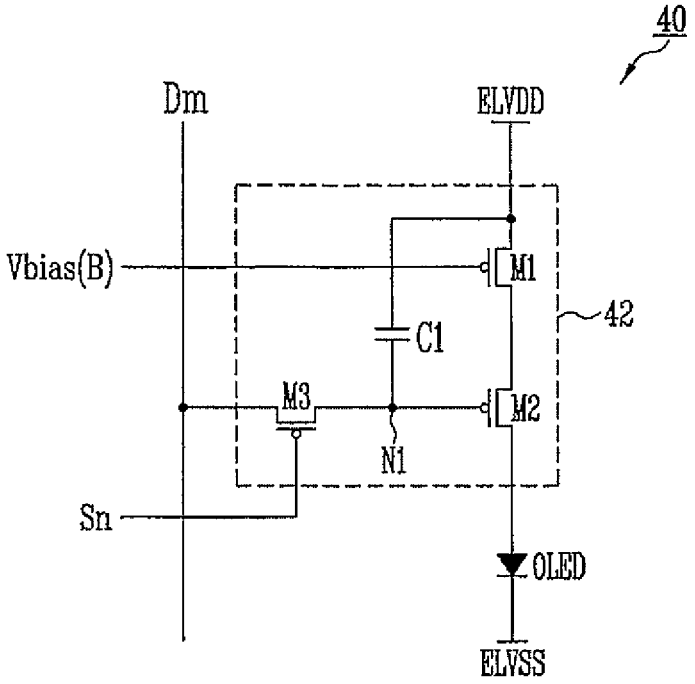
FIG. 3 is a view illustrating a pixel according to a first embodiment of the present invention.

FIG. 3 is a view illustrating a pixel according to a first embodiment of the present invention. In FIG. 3, for convenience sake, a pixel coupled to the nth scan line Sn and the mth data line Dm will be illustrated.

Referring to FIG. 3, a pixel 40 according to the first embodiment of the present invention includes an organic light emitting diode (OLED) and a pixel circuit 42 configured to control whether to supply a current to the OLED to correspond to a data signal.

A first electrode of a second transistor M2 is coupled to a second electrode of a first transistor M1 and a second electrode of the second transistor M2 is coupled to an anode electrode of the OLED. A gate electrode of the second transistor M2 is coupled to a first node N1. The second transistor M2 is turned on or off to correspond to a voltage of the first node N1.

That is, the second transistor M2 is set in a turn-on state when the voltage corresponding to the first data signal is applied to the first node N1 and is set in a turn-off state when the voltage corresponding to the second data signal is applied to the first node N1. The second transistor M2 performs a turn on or off switch and is driven in a linear region.

On the other hand, when the second transistor M2 is set in the turn-on state, the OLED is coupled to the first transistor M1 driven as a current supply. That is, when the second transistor M2 is set in the turn-on state, the OLED is not directly coupled to the first voltage supply ELVDD but is coupled to the first transistor M1 driven as the current supply. In this case, deterioration of the OLED is reduced or minimized so that a lifespan of the OLED may be increased.

That is, in comparable digital driving, since the OLED is directly coupled to the voltage supply, the OLED is rapidly deteriorated. However, according to the present invention, since the OLED is driven to correspond to a current supplied from the current supply M1, a deterioration pace (speed) may be reduced in comparison with the comparable art. In addition, although the OLED is deteriorated, an amount of current supplied from the first transistor M1 is uniformly maintained so that an image with desired brightness may be realized.

A first electrode of a third transistor M3 is coupled to the data line Dm, and a second electrode of the third transistor M3 is coupled to the first node N1. A gate electrode of the third transistor M3 is coupled to the scan line Sn. The third transistor M3 is turned on when the scan signal is supplied to the scan line Sn to supply the data signal from the data line Dm to the first node N1.

The first capacitor C1 is coupled between the first power supply ELVDD and the first node N1. The first capacitor C1 stores the voltage corresponding to the first data signal or the second data signal.

Figure 4:
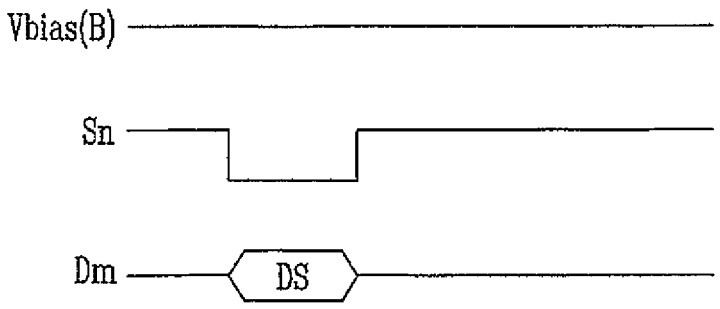
FIG. 4 is a waveform diagram illustrating a method of driving the pixel illustrated in FIG. 3.

FIG. 4 is a waveform diagram illustrating a method of driving the pixel illustrated in FIG. 3.

Referring to FIG. 4, the bias voltage Vbias (B) is set to have a set or predetermined value so that a current corresponding to the highest gray scale may be supplied from the first transistor M1. Therefore, the first transistor M1 that receives the bias voltage Vbias (B) is driven as the current supply corresponding to the bias voltage Vbias (B).

Then, the scan signals are sequentially supplied to the scan lines S1 to Sn in scan periods of the sub-frames SF1 to SF8 to correspond to gray scales to be realized, and the first data signal or the second data signal is supplied to each of the data lines D1 to Dm to correspond to the scan signals.

When the scan signal is supplied to the nth scan line Sn, the third transistor M3 is turned on. When the third transistor M3 is turned on, the data line Dm and the first node N1 are electrically coupled to each other. Then, the first data signal or the second data signal from the data line Dm is supplied to the first node N1 and the first capacitor C1 charges a voltage corresponding to the first node N1.

Then, the second transistor M2 is turned on or off to correspond to the data signal. Here, when the second transistor M2 is turned on, a set or predetermined current is supplied from the first transistor M1 to the OLED so that the OLED is set in the emission state. When the second transistor M2 is turned off, the current is not supplied to the OLED so that the OLED is set in the non-emission state.

As described above, according to an embodiment of the present invention, the first transistor M1 is driven in a saturation region and the second transistor M2 is driven in the linear region. When the first transistor M1 is driven in the saturation region, the first transistor M1 is driven as the current supply so that it is possible to uniformly maintain an amount of current supplied to the OLED and to prevent brightness from being reduced by deterioration of the OLED. In addition, when the second transistor M2 is driven in the linear region, delay caused by charge/discharge of the data signal is reduced or minimized so that a driving speed may be increased.

Figure 5:
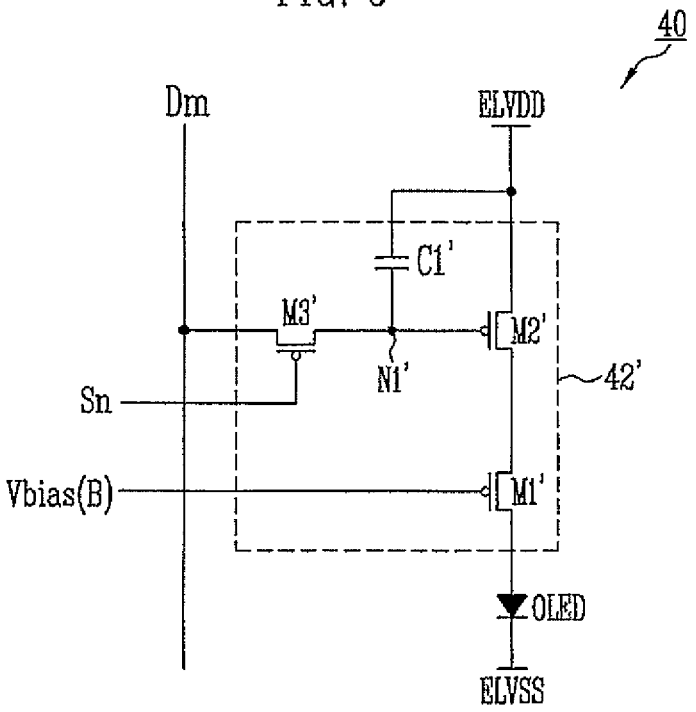
FIG. 5 is a view illustrating a pixel according to a second embodiment of the present invention.

FIG. 5 is a view illustrating a pixel according to a second embodiment of the present invention. In describing FIG. 5, the same elements as those of FIG. 3 are denoted by the same reference numerals and detailed description thereof will not be provided again.

Referring to FIG. 5, a pixel 40 according to the second embodiment of the present invention includes an OLED and a pixel circuit 42' configured to control whether to supply a current to the OLED.

The pixel circuit 42' includes a first transistor M1', a second transistor M2', a third transistor M3', and a first capacitor C1'.

The second transistor M2' is coupled between a first electrode of the first transistor M1' and the first power supply ELVDD. A gate electrode of the second transistor M2' is coupled to a first node N1'. The second transistor M2' is turned on or off to correspond to a data signal. That is, the second transistor M2' is driven in the form of a switch in a linear region.

The first electrode of the first transistor M1' is coupled to a second electrode of the second transistor M2' and a second electrode of the first transistor M1' is coupled to the OLED. A gate electrode of the first transistor M1' receives the bias voltage (B). The first transistor M1' is driven as a current supply in a saturation region to correspond to the bias voltage.

A first electrode of the third transistor M3' is coupled to the data line Dm and a second electrode of the third transistor M3' is coupled to the first node N1'. A gate electrode of the third transistor M3' is coupled to the scan line Sn. The third transistor M3' is turned on when the scan signal is supplied to the scan line Sn to supply the data signal from the data line Dm to the first node N1'.

The first capacitor C1' is coupled between the first power supply ELVDD and the first node N1'. The first capacitor C1' stores the voltage corresponding to the first data signal or the second data signal.

Operating processes of the second embodiment of the present invention are the same as those of the first embodiment, but positions of the first transistor M1' and the second transistor M2' are changed as compared to the first transistor M1 and the second transistor M2 of the first embodiment.

Figure 6:
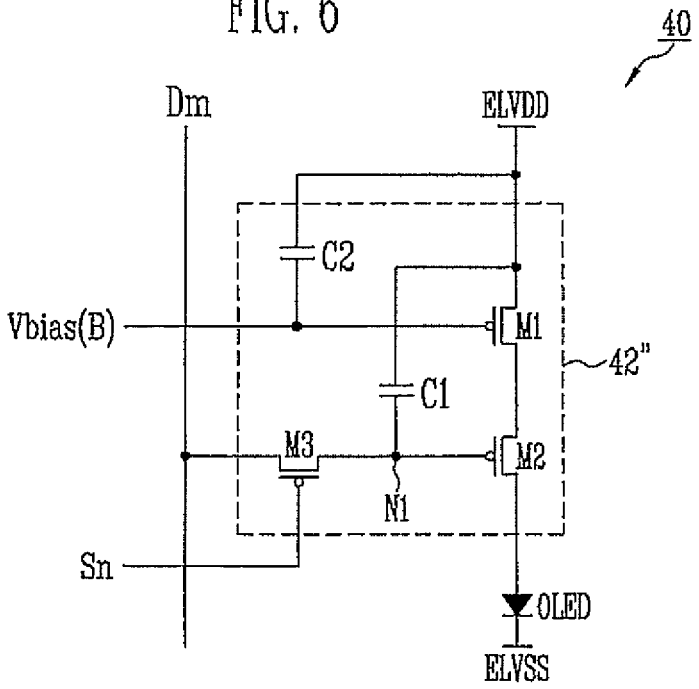
FIG. 6 is a view illustrating a pixel according to a third embodiment of the present invention.

FIG. 6 is a view illustrating a pixel according to a third embodiment of the present invention. In describing FIG. 6, the same elements as those of FIG. 3 are denoted by the same reference numerals and detailed description thereof will not be provided again.

Referring to FIG. 6, a pixel 40 according to the third embodiment of the present invention includes an OLED and a pixel circuit 42" configured to control whether to supply a current to the OLED.

The pixel circuit 42" includes a second capacitor C2 coupled between the gate electrode of the first transistor M1 and the first power supply ELVDD. The second capacitor C2 stably maintains the bias voltage Vbias (B).

To be specific, a voltage of the gate electrode of the first transistor ml may be changed by a parasitic capacitor. For example, whenever the voltage of the data signal is changed by the parasitic capacitor between the data line Dm and the gate electrode of the first transistor M1, the voltage of the gate electrode of the first transistor M1 may be changed. The second capacitor C2 may prevent the voltage of the gate electrode of the first transistor M1 from being changed by the parasitic capacitor and may improve reliability of an operation.

Figure 7:
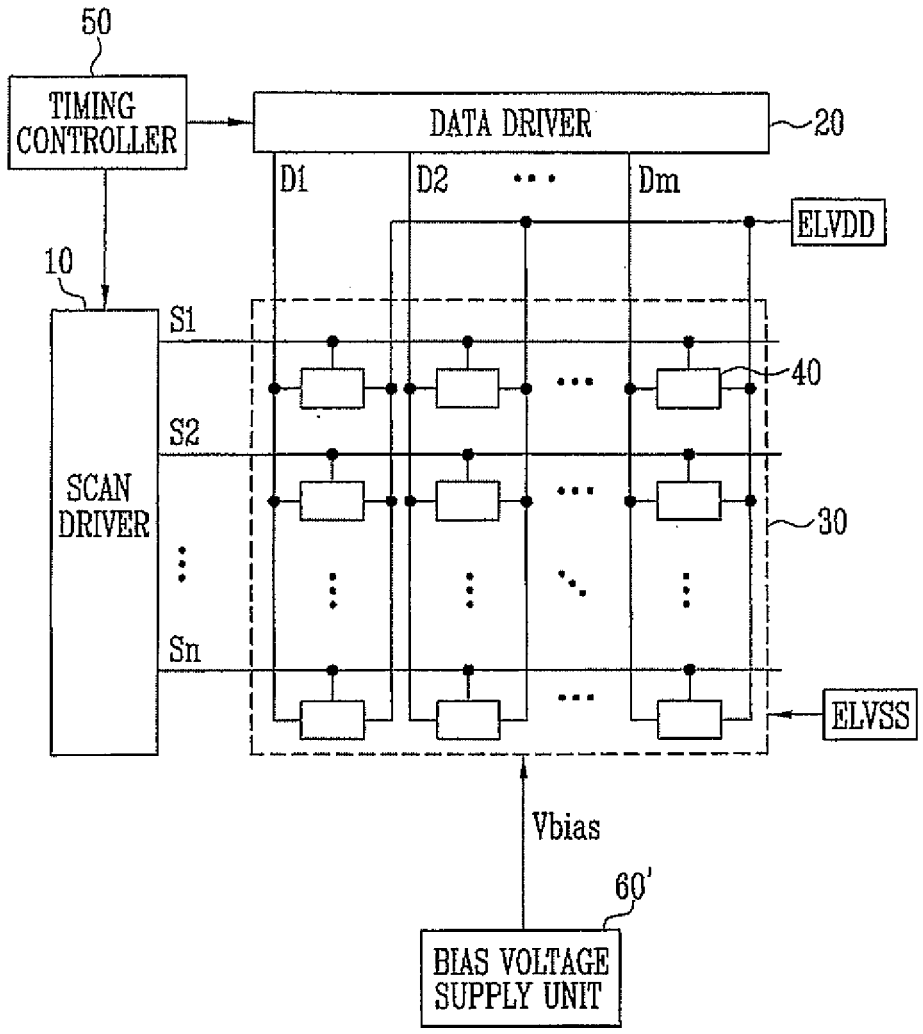
FIG. 7 is a view illustrating an organic light emitting display device according to another embodiment of the present invention.

FIG. 7 is a view illustrating an organic light emitting display according to another embodiment of the present invention. In describing FIG. 7, the same elements as those of FIG. 1 are denoted by the same reference numerals and detailed description thereof will be omitted.

Referring to FIG. 7, a bias voltage supply 60' of an organic light emitting display device according to the other embodiment of the present invention supplies the same bias voltage Vbias to all of the pixels 40. That is, the bias voltage supply 60' supplies the same bias voltage Vbias to the pixels 40 that generate red, green, and blue light components. In this case, signal wiring lines configured to transmit the bias voltage Vbias are reduced, which is advantageous to high resolution.

On the other hand, when the same bias voltage Vbias is supplied to the red, green, and blue pixels 40, currents that correspond to the highest gray scales may not flow in the pixels 40. According to the present invention, in order to solve the problem, channel widths/lengths W/L of the first transistors M1 included in the red, green, and blue pixels 40 to receive the bias voltage Vbias may be set different from each other.

That is, the channel width/length of the first transistor M1 included in the red pixel 40 is set different from the channel width/length of the first transistor M1 included in the green pixel 40. The channel width/length of the first transistor M1 included in the blue pixel 40 is set different from the channel widths/lengths of the first transistors M1 included in the red and green pixels. Here, the channel widths/lengths of the first transistors M1 included in the red, green, and blue pixels 40 are set so that the currents corresponding to the highest gray scales may flow. Additionally, according to an embodiment of the present invention, emission times of the red, green, and blue pixels 40 may be controlled.

On the other hand, according to embodiments of the present invention, for convenience sake, the transistors are illustrated as PMOS transistors. However, the present invention is not limited to the above. That is, the transistors may be formed of NMOS transistors.

In addition, according to the present invention, the OLED generates light of a specific color to correspond to the amount of current supplied from the driving transistor. However, the present invention is not limited to the above. For example, the OLED may generate white light to correspond to the amount of current supplied from the driving transistor. In this case, a color image is realized using an additional color filter.

By way of summation and review, an organic light emitting display device includes a plurality of pixels arranged at crossing regions (e.g., at intersections) of a plurality of data lines, scan lines, and power supply lines in a matrix. Each of the pixels is commonly formed of an OLED, at least two transistors including a driving transistor, and at least one capacitor.

The organic light emitting display device has low power consumption. However, an image with desired brightness may not be displayed due to deterioration of the OLEDs.

The organic light emitting display device according to the embodiment of the present invention realizes gray scales using the transistors driven by the bias voltages as the current supplies and the transistors driven by the data signals as the switches. Here, the transistors driven as the current supplies supply uniform currents regardless of the deterioration of the OLEDs so that it is possible to prevent brightness from being reduced due to the deterioration of the OLEDs. In addition, since the OLEDs are not directly coupled to the first power supply but receive the currents from the transistors driven as the current supplies, the deterioration of the OLEDs is minimized or reduced so that an image with desired brightness may be displayed.

Example embodiments have been disclosed herein, and although specific terms are employed, they are used and are to be interpreted in a generic and descriptive sense only and not for purpose of limitation. In some instances, as would be apparent to one of ordinary skill in the art at the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display device, comprising:

pixels positioned at crossing regions of scan lines and data lines; and a bias voltage supply configured to supply bias voltages to the pixels, wherein each of the pixels comprises:

an organic light emitting diode (OLED);

a first transistor coupled between a first power supply and the OLED and configured to be driven in a saturation region by a corresponding one of the bias voltages to supply a set current to the OLED, a gate electrode of the first transistor being directly connected to the bias voltage supply without any components connected in series between the bias voltage supply and the gate electrode of the first transistor;

a second transistor coupled between the first power supply and the OLED and configured to be driven in a linear region by a data signal supplied from a corresponding one of the data lines to turn on or off; and a second capacitor configured to maintain the corresponding one of the bias voltages wherein the second capacitor is directly connected to the gate electrode of the first transistor without any components connected in series between the second capacitor and the gate electrode of the first transistor, and directly connected to the first power supply without any components connected in series between the second capacitor and the first power supply.

2. The organic light emitting display device as claimed in claim 1, wherein each of the pixels comprises:

a first capacitor coupled between a gate electrode of the second transistor and the first power supply; and a third transistor coupled between the gate electrode of the second transistor and the data line and configured to turn on when a scan signal is supplied to a corresponding one of the scan lines.

3. The organic light emitting display device as claimed in claim 1, wherein the set current corresponds to the highest gray scale realized by a corresponding one of the pixels.

4. The organic light emitting display device as claimed in claim 3, wherein the bias voltage supply is configured to supply the bias voltages as different voltages to a red pixel of the pixels for generating red light, a green pixel of the pixels for generating green light, and a blue pixel of the pixels for generating blue light.

5. The organic light emitting display device as claimed in claim 3, wherein channel widths/lengths of the first transistors included in a red pixel for generating red light, a green pixel for generating green light, and a blue pixel for generating blue light are set different from each other so that the current corresponding to the highest gray scale flows to each of the red, green, and blue pixels.

6. The organic light emitting display device as claimed in claim 1, further comprising:

a scan driver configured to supply scan signals to the scan lines; and a data driver configured to supply data signals, comprising the data signal, to the data lines.

7. The organic light emitting display device as claimed in claim 6, wherein one frame is divided into a plurality of sub-frames, and wherein the scan driver is configured to supply the scan signals to the scan lines in scan periods of the sub-frames.

8. The organic light emitting display device as claimed in claim 6, wherein the data driver is configured to supply a first data signal of the data signals at which the pixels emit light or a second data signal of the data signals at which the pixels do not emit light to each of the data lines in synchronization with the scan signals.

9. The organic light emitting display device as claimed in claim 1, wherein the first transistor is positioned between the second transistor and the first power supply.

10. The organic light emitting display device as claimed in claim 1, wherein the first transistor is positioned between the second transistor and the OLED.

11. An organic light emitting display device, comprising:

pixels positioned at crossing regions of scan lines and data lines; and a bias voltage supply configured to supply bias voltages to the pixels, wherein each of the pixels comprises:

an organic light emitting diode (OLED); and a pixel control circuit having at most three transistors, the pixel control circuit comprising:

a first transistor coupled between a first power supply and the OLED and configured to be driven in a saturation region by a corresponding one of the bias voltages to supply a set current to the OLED;

a second transistor coupled between the first power supply and the OLED and configured to be driven in a linear region by a data signal supplied from a corresponding one of the data lines to turn on or off; and a second capacitor configured to maintain the corresponding one of the bias voltages wherein the second capacitor is directly connected to a gate electrode of the first transistor without any components connected in series between the second capacitor and the gate electrode of the first transistor, and directly connected to the first power supply without any components connected in series between the second capacitor and the first power supply.

12. The organic light emitting display device as claimed in claim 11, wherein the pixel control circuit further comprises:

a first capacitor coupled between a gate electrode of the second transistor and the first power supply; and a third transistor coupled between the gate electrode of the second transistor and the data line and configured to turn on when a scan signal is supplied to a scan line.

13. The organic light emitting display device as claimed in claim 11, wherein the set current corresponds to the highest gray scale realized by the pixel.

14. The organic light emitting display device as claimed in claim 11, wherein the first transistor is positioned between the second transistor and the first power supply.

15. The organic light emitting display device as claimed in claim 11, wherein the first transistor is positioned between the second transistor and the OLED.

* * * * *